US009736896B2

(12) United States Patent
Pauritsch et al.

(10) Patent No.: US 9,736,896 B2
(45) Date of Patent: Aug. 15, 2017

(54) DRIVER ASSEMBLY AND METHOD FOR DETECTING AN ERROR CONDITION OF A LIGHTING UNIT

(75) Inventors: Manfred Pauritsch, Graz (AT); Werner Schögler, Graz (AT); Stefan Wiegele, Graz (AT)

(73) Assignee: AMS AG, Unterpremstaetten (AT)

( * ) Notice: Subject to any disclaimer, the term of this patent is extended or adjusted under 35 U.S.C. 154(b) by 0 days.

(21) Appl. No.: 14/127,922

(22) PCT Filed: May 29, 2012

(86) PCT No.: PCT/EP2012/060045

§ 371 (c)(1),
(2), (4) Date: Mar. 24, 2014

(87) PCT Pub. No.: WO2012/175288

PCT Pub. Date: Dec. 27, 2012

(65) Prior Publication Data

US 2014/0225508 A1 Aug. 14, 2014

(30) Foreign Application Priority Data

Jun. 24, 2011 (DE) ..... 10 2011 105 550

(51) Int. Cl.
*H05B 33/08* (2006.01)

(52) U.S. Cl.
CPC ..... *H05B 33/083* (2013.01); *H05B 33/089* (2013.01); *H05B 33/0887* (2013.01)

(58) Field of Classification Search
CPC ..... H05B 33/083; H05B 33/089
(Continued)

(56) References Cited

U.S. PATENT DOCUMENTS 6,490,512 B1 * 12/2002 Niggemann ..... 701/29.1
7,148,632 B2 12/2006 Berman et al.
(Continued)

FOREIGN PATENT DOCUMENTS

DE 10215486 C1 10/2003
DE 102004034359 B3 2/2006
(Continued)

*Primary Examiner* — Douglas W Owens
*Assistant Examiner* — Pedro C Fernandez
(74) *Attorney, Agent, or Firm* — McDermott Will & Emery LLP

(57) ABSTRACT

A driver assembly (100) for a lighting unit (230) comprises a control unit (110). The lighting unit (230) comprises a plurality of strands (240, 250, 260), wherein each strand comprises a series circuit (242, 252, 262) of light-emitting diodes and a current source (243, 253, 263) with a first and a second terminal (246, 256, 266), and wherein the series circuit (242, 252, 262) of diodes is connected between a supply voltage input (231) of the lighting unit (230) and the first terminal of the current source (243, 253, 263) and the second terminal (246, 256, 266) of the current source is connected to a reference potential terminal via a resistor (245, 255, 265). The control unit (110) is designed for generating a corresponding control signal for a voltage converter (210) from a respectively adjusted control value, wherein said voltage converter is designed for making available an output voltage at the supply voltage input (231) of the lighting unit (230) based on the control signal, for acquiring a measured value at each of the second terminals (246, 256, 266) of the current sources (243, 253, 263), for storing an adjusted control value for each strand (240, 250, 260) based on the acquired measured values and for detecting whether an error condition exists in one of the strands (240, 250, 260) based on the stored control values.

16 Claims, 4 Drawing Sheets

Figure 1:
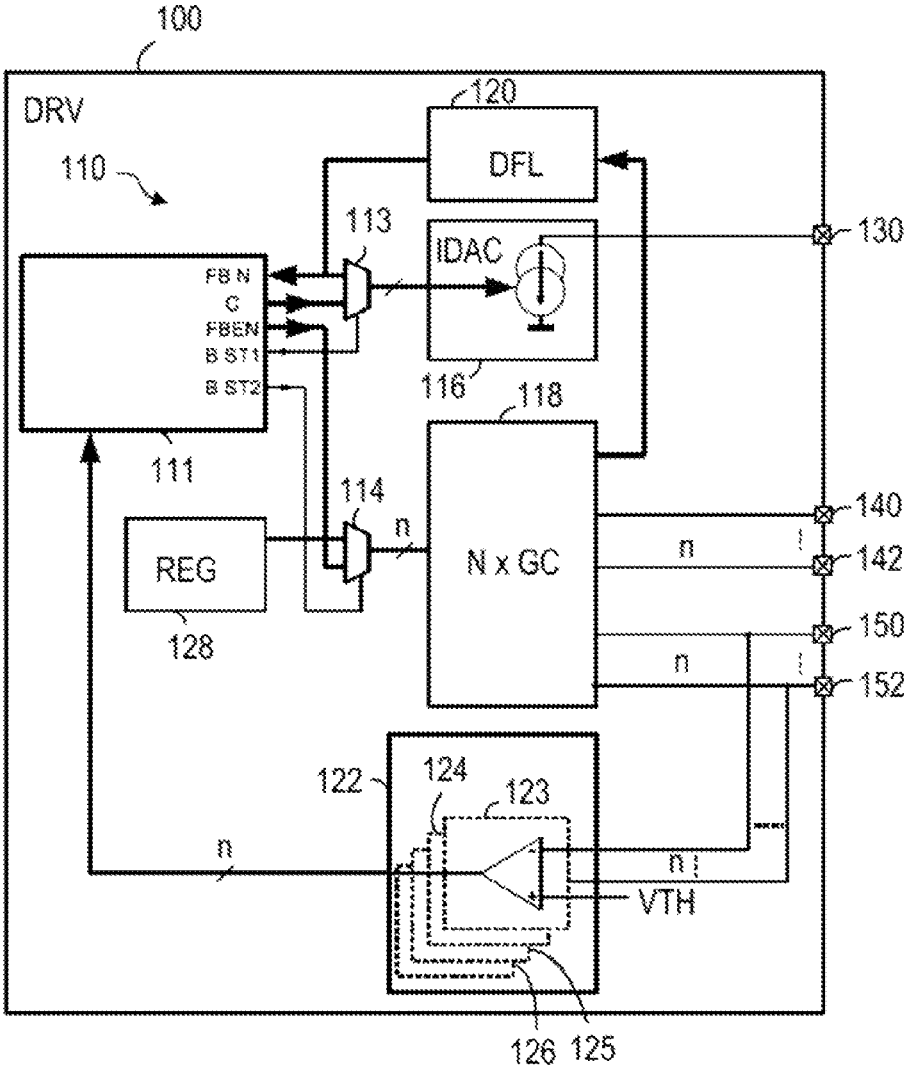

(58) Field of Classification Search
USPC ..... 315/122; 345/82
See application file for complete search history.

(56) References Cited

U.S. PATENT DOCUMENTS

| | | | | |
|---|---|---|---|---|
| 2007/0195025 | A1 | 8/2007 | Korcharz et al. | |
| 2008/0204029 | A1* | 8/2008 | Mihai et al. | 324/414 |
| 2013/0304304 | A1* | 11/2013 | Schnerr et al. | 701/29.2 |

FOREIGN PATENT DOCUMENTS

| | | | |
|---|---|---|---|
| EP | 1965609 | A2 | 9/2008 |
| EP | 2247161 | A1 | 11/2010 |

* cited by examiner

DRIVER ASSEMBLY AND METHOD FOR DETECTING AN ERROR CONDITION OF A LIGHTING UNIT

The invention pertains to a driver assembly for a lighting unit, a lighting arrangement with such a driver assembly and a method for detecting an error condition of a lighting unit.

Lighting units, in which the lamps consist of light-emitting diodes or LEDs, are frequently used in modern lighting systems. Such lighting units are used, for example, as backlighting for LCD-based or TFT-based flat screens. Driver assemblies that control the current and the voltage at the lighting unit are usually provided for driving the lighting units. For example, such a lighting unit comprises several strands of series-connected LEDs, wherein each strand is provided with a controlled current source that can define the current through the series circuit of diodes. In many instances, all strands are supplied with the same operating voltage that is made available, for example, by a switched voltage converter.

In addition to the actual driver function, such a driver assembly for a lighting unit may also comprise means for error detection in the lighting unit, wherein said error detection means make it possible, for example, to detect strands that are not connected to the operating voltage or through which no current flow takes place due to component defects, mechanical damage or the like.

Such means can be further used for attempting to detect whether a short circuit exists in one of the series circuits of diodes and electrically bypasses one or more diodes in the series circuit. In such an instance, the reduced voltage drop over the series circuit of diodes can lead to an increased load on the current source such that it produces, for example, more dissipated power that is emitted in the form of heat by the lighting unit. This can result in the lighting unit or the driver assembly no longer operating in a safe operating range, wherein this can in turn lead to damage of circuit components or even the endangerment of a user of the device in question.

In conventional driver assemblies, a voltage is tapped, for example, at the connecting point between the series circuit of LEDs and the current source in order to detect a possible error condition of the corresponding strand based on this voltage because this voltage directly reflects the voltage drop over the series circuit of diodes. However, relatively high voltages in the range of the operating voltage of the lighting unit as well as very low voltages, for example 0, may occur at this measuring point depending on the line status of the series circuit. An error evaluation circuit in a conventional driver assembly therefore is associated with increased expenditures because it also needs to be designed for processing such high voltages.

In applications with higher operating voltages for the lighting unit, it may be further necessary to provide additional external components that lower the potentially high measured voltage at the aforementioned measuring points to a voltage level that can be processed by the driver assembly.

It is an object of the invention to disclose an improved concept for detecting an error condition in a lighting unit with several strands of light-emitting diodes.

This object is achieved with the subject-matter of the independent claims. Embodiments and enhancements form the subject-matter of the dependent claims.

For example, a lighting unit, in which a potential error condition should be detected, comprises a plurality of strands. Each strand of the lighting unit comprises a series circuit of light-emitting diodes and a current source with a first and a second terminal, wherein the series circuit of diodes is connected between a supply voltage input of the lighting unit and the first terminal of the current source, and the second terminal of the current source is connected to a reference potential terminal via a resistor. The light-emitting diodes consist, for example, of conventional LEDs or of laser diodes.

An output voltage of a voltage converter that is made available to the lighting unit at the supply voltage input can be adjusted during regular operation, as well as when a potential error condition is detected, by means of a control value or a control signal.

At the second terminal of the current source of each strand, measured values are acquired in order to detect a potential error condition in one or more strands based on the measured values as well as adjusted control values or control signals. The measured values correspond, for example, to the respective voltage drop through the resistor of the strand. The measurement at the second terminal of the current source makes it possible to analyze whether an error condition exists in one of the strands with less effort and independently of a potentially higher or excessively high voltage at the first terminal of the current source. Accordingly, the second terminal of the respective current sources can also be referred to as a current measurement terminal.

According to one embodiment, a driver assembly for a lighting unit comprises a control unit as described above. The control unit is designed for generating a corresponding control signal for a voltage converter from a respectively adjusted control value in the control unit, wherein the voltage converter is designed for making available an output voltage at the supply voltage input of the lighting unit based on said control signal. The control unit is also designed for acquiring a measured value at each of the second terminals of the current sources and for storing one of the adjusted control values for each strand based on the acquired measured values. The control unit is further designed for detecting whether an error condition exists in one of the strands based on the stored control values.

In this way, measured values can be respectively acquired at the second terminals of the current sources of the individual strands for certain control values or control signals, for example, in order to analyze a potential error condition of each strand based on a combination of the acquired measured value and the corresponding adjusted control value. In this case, the adjusted control value can be stored together with the measured value when a certain measured value is present or the measured value can be stored together with a certain adjusted control value in the form of the result of the adjustment.

The measurement at the second terminals of the current sources or at a connecting point between the current source and the resistor can be carried out with little effort and without requiring additional circuitry elements, for example, for voltage protection. It is possible, in particular, to forgo a measurement at the first terminals of the current sources, to which voltages that exceed the operating range of the driver assembly are usually applied.

For example, the control unit is designed for detecting whether one or more diodes are electrically bypassed, particularly bypassed in a low-ohmic fashion, and/or short-circuited in one of the strands based on the stored control values. It is therefore possible to detect, for example, whether a short circuit situation that jeopardizes the respective operating safety of the lighting unit or the driver assembly exists in one or more of the strands. In case such an error condition is detected, the concerned strand can be deactivated, for example, by the driver assembly while the remaining strands without an error condition can remain in operation.

According to one embodiment, the control unit is designed for variably adjusting the control value, for determining a line status of each strand for the adjusted control value based on the acquired measured value, as well as for detecting whether an error condition exists in one of the strands based on the determined line statuses for at least two different control values.

The line status is respectively defined, for example, by whether or not a current flow through the strand is present or whether or not electric conduction in the strand takes place.

The control unit is designed, for example, for determining the line status of the strand by comparing the measured value acquired at the second terminal of the current source of the strand with a status reference value. For example, the driver assembly or the control unit comprises one or more comparators, to which the measured value of each strand and the status reference value are fed.

In different embodiments, the control unit adjusts two or more different control values that lead to different output voltages of the voltage converter being applied to the voltage supply input of the lighting unit. The corresponding line status can be determined for each of the different voltage values at the supply voltage input of the lighting unit based on the measured value acquired on each strand. An evaluation of the respectively adjusted control value and the resulting line statuses of the individual strands makes it possible to deduce a potential error condition of the individual strands. This is based, in particular, on possible status changes of the line status in the individual strands at different adjusted control values.

For example, the control unit is designed for adjusting the control value incrementally in several steps and for determining the control value for each strand at which the line status of the strand changes based on the line statuses determined for the adjusted control values in order to obtain a change-over control value for the strand. In this case, the control unit is further designed for detecting whether an error condition exists in one of the strands based on the change-over control values.

The adjustment of the control values takes place, for example, in value-increasing steps or alternatively in value-decreasing steps, but preferably with a monotonic gradient in any case.

It is particularly proposed, for example, that the line status of each individual strand be determined for each adjusted control value and that whether the line status of a strand for the adjusted control value differs from the line status for the last adjusted control value be checked. If such a line status change or line status change-over is detected in a strand, the currently adjusted control value or the last adjusted control value is stored as a change-over control value for the strand. A detection of an error condition in a strand is carried out, for example, by means of a comparison of the individual change-over control values of the strands.

In one embodiment, the control unit is designed for determining an extreme value of the change-over control values, i.e., a maximum value or a minimum value, and for detecting an error condition in a strand when a deviation between the change-over control value of this strand and the extreme value exceeds a change-over threshold value. When no error exists in the strands, it is expected that the change-over control values will lie within a certain range that is defined, for example, by the manufacturing tolerances with respect to the conducting-state voltages of the diodes. At an excessive deviation from the extreme value, it is assumed that the deviation beyond the manufacturing tolerances is caused by an error condition. Accordingly, an error condition in the strand is detected if the deviation exceeds the change-over threshold value.

In another embodiment of the driver assembly in which the control unit is designed for variably adjusting the control value and for determining a line status of the strand for the adjusted control value based on the acquired measured values for each strand, the control unit is also designed for adjusting the control value to a first control value and for determining the line status of each strand for the first control value, as well as for adjusting the control value to a second control value and for determining the line status of each strand for the second control value. In this case, the control unit is further designed for detecting an error condition in a strand if the line status of this strand for the first control value is identical to the line status of this strand for the second control value.

For example, the first control value is chosen in such a way that, as expected, all strands have the same line status, e.g. all strands are in a current-conducting state. The second control value is chosen, for example, in such a way that strands in which no error condition exists have a different line status for the second control value, wherein these strands are, for example, not in a current-conducting state. However, if one of the strands does not show a change in its line status between the first and the second control value, it can be assumed that an error condition exists in this strand such that an error condition for this strand is detected by the control unit.

The first control value is chosen, for example, from a conventional operating range for the operation of the lighting unit, in which a sufficient voltage for driving the strands is made available at the supply voltage input of the lighting unit. The second control value is provided for a voltage of the voltage converter that is lower than the output voltage for the first control value, wherein this second, lower output voltage is chosen, for example, in such a way that it is, as expected, not suitable for a sufficient voltage supply during the operation of the lighting unit.

According to another embodiment, the control unit is designed for activating the current source of each strand individually and deactivating the current sources of the other strands, for adjusting the control value in such a way that the measured value of the strand with the activated current source reaches a predetermined value, as well as for storing the adjusted control value for the strand with the activated current source. The control unit is further designed for detecting whether an error condition exists in one of the strands based on a comparison of the stored control values.

The current sources in the strands can be respectively adjusted or controlled, for example, by means of a control voltage such that a current source of this type can be deactivated, for example, by not supplying a control voltage to the current source. The output voltage of the voltage converter is controlled based on the measured value of the only strand that is respectively activated by varying the control value generated by the control unit in order to thusly control the voltage converter. Due to manufacturing tolerances of the diodes, the output voltage that needs to be adjusted in order to reach a predetermined value for the measured value at the second terminal may deviate between the individual strands. However, such a deviation usually lies within previously established limits such that an excessive deviation of the control value to be adjusted indicates an error condition in the concerned strand.

For example, the control unit is designed for determining an extreme value of the stored control values, for example a minimum value or a maximum value, and for detecting an error condition in a strand if a deviation between the stored control value of this strand and the extreme value exceeds an activation threshold value.

When diodes in a strand are bypassed or short-circuited, for example, a lower output voltage of the voltage converter is required for obtaining the predetermined value as a measured value of this strand. This accordingly results in a deviation of this strand from the extreme value, particularly from the maximum value of the control values, which exceeds the activation threshold value.

Another aspect pertains to a lighting arrangement with a driver assembly according to one of the above-described embodiments, with a lighting unit of the above-described type and with a voltage converter that is designed for making available an output voltage at the voltage supply input of the lighting unit based on a control signal delivered by the driver assembly.

Another aspect pertains to a method for detecting an error condition of a lighting unit of the above-described type. According to one embodiment of this method, at least two control values are successively adjusted and a control signal for a voltage converter is generated from a respectively adjusted control value, wherein said voltage converter is designed for making available an output voltage at the supply voltage input of the lighting unit based on the control signal. A measured value is acquired at each of the second terminals of the current sources. One of the adjusted control values is stored for each strand based on the acquired measured values and whether an error condition exists in one of the strands is detected based on the stored control values.

In one embodiment of the method, a variable adjustment of the control value, a determination of a line status of each individual strand for the adjusted control value based on the acquired measured values, as well as a detection of whether an error condition exists in one of the strands based on the determined line statuses for at least two different control values are further carried out.

According to another embodiment of the method, the current source of each individual strand is activated and the current sources of the other strands are deactivated. The control value is adjusted in such a way that the measured value of the strand with the activated current source reaches a predetermined value. The control value adjusted for the strand with the activated current source is stored and whether an error condition exists in one of the strands is detected based on a comparison of the stored control values.

Other embodiments of the method result from the different embodiments that are respectively described with reference to the driver assembly and the control unit of the driver assembly. For example, the described method can be carried out, in particular, with or in such a driver assembly or control unit.

Several exemplary embodiments of the invention are described in greater detail below with reference to the figures. In the figures, elements with identical function or action are identified by the same reference symbols.

Figure 2:
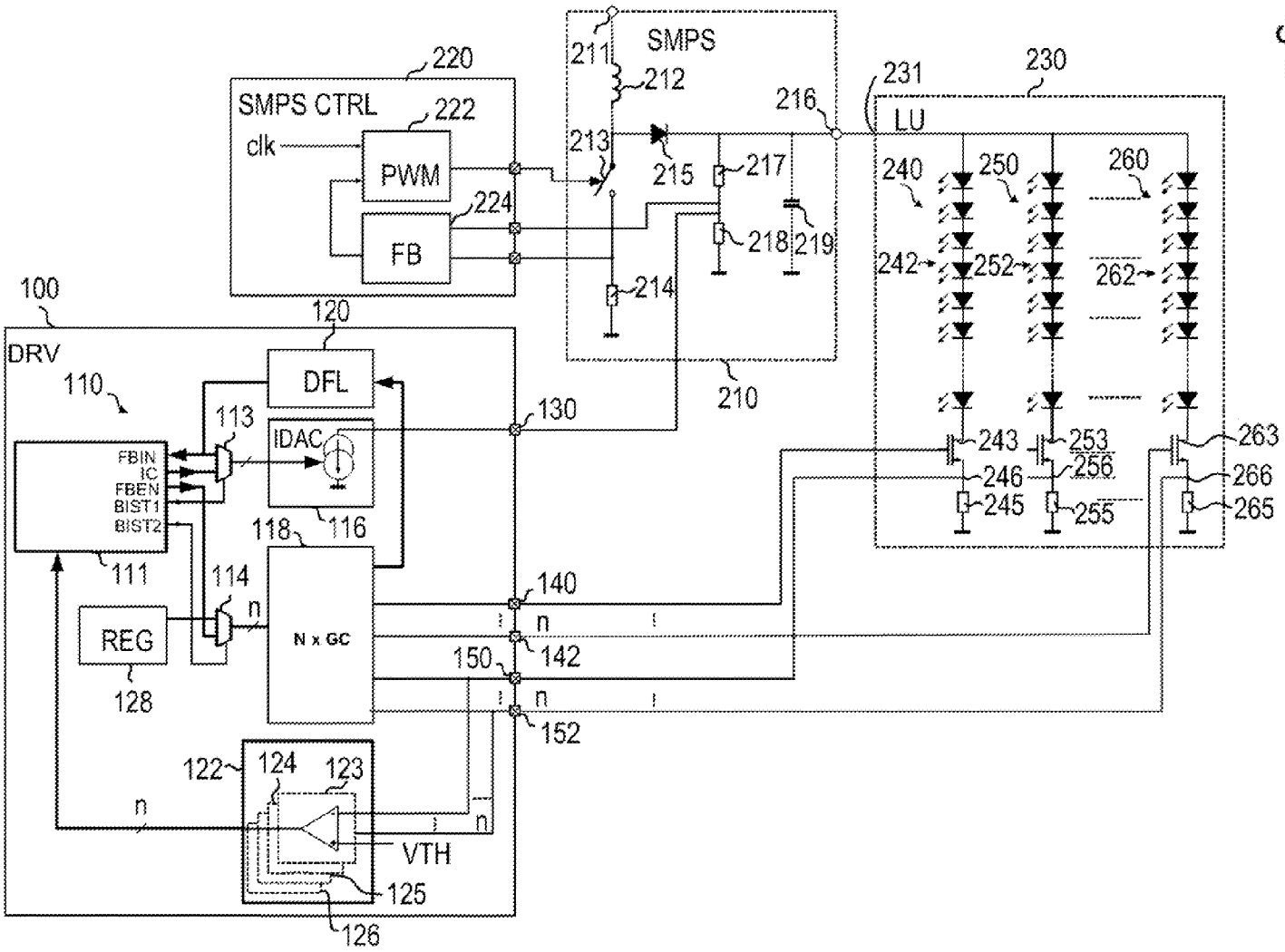
Figure 3:
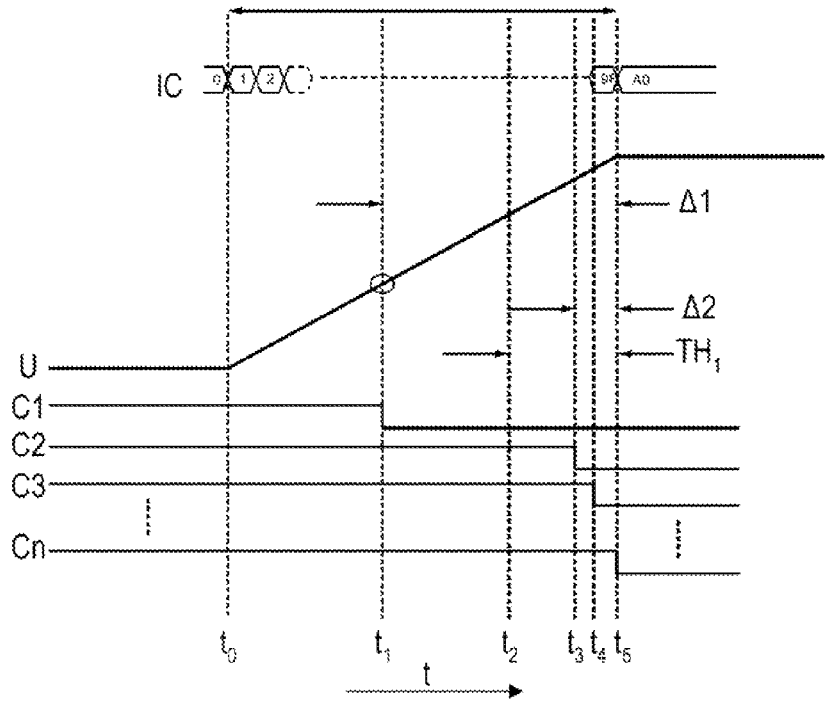
Figure 4:
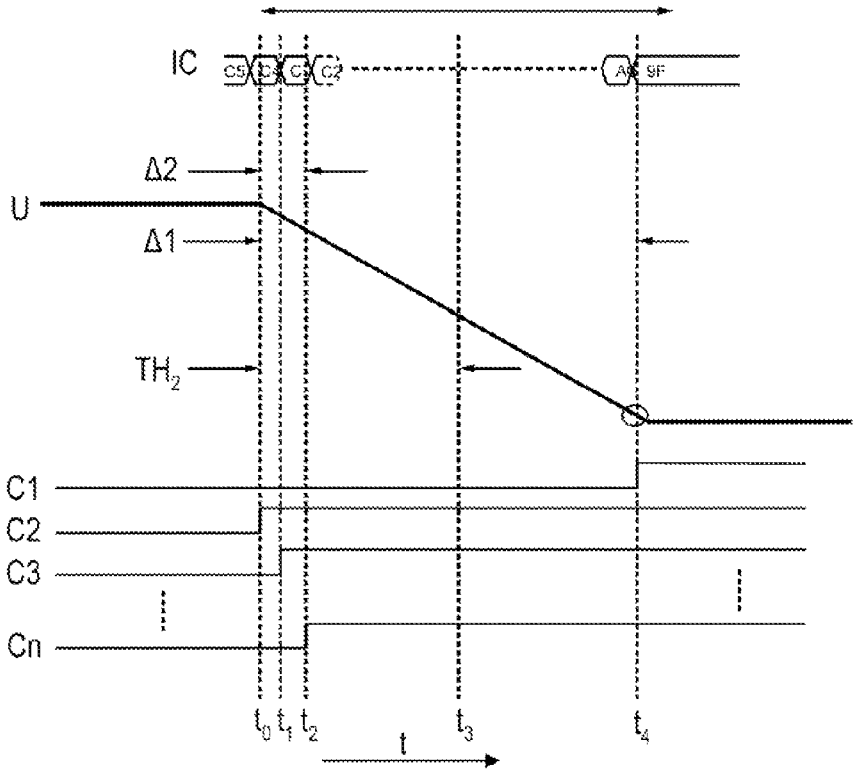
Figure 5:
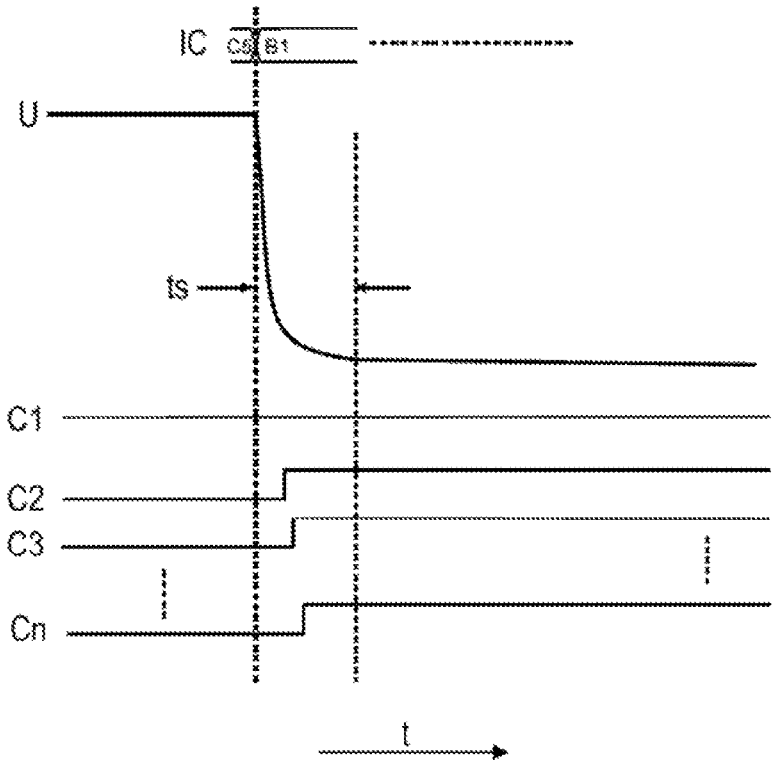
Figure 6:
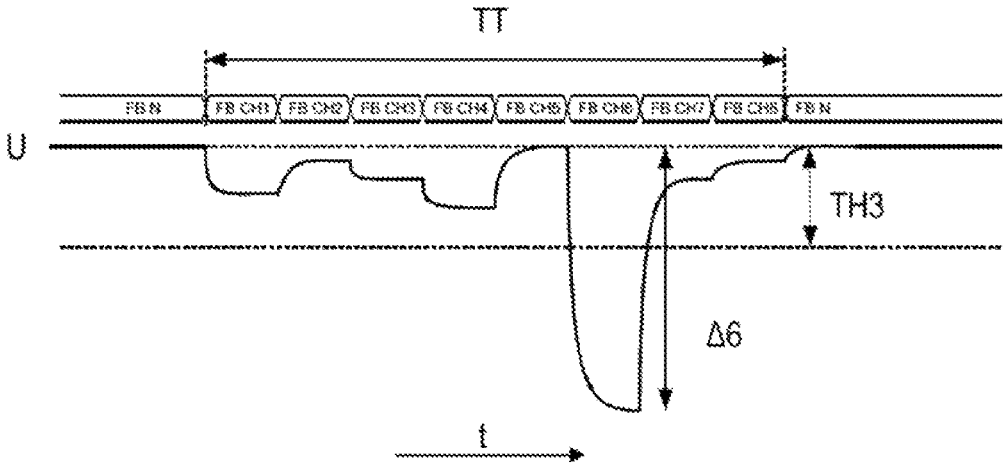

In these figures:

FIG. 1 shows an exemplary embodiment of a driver assembly,

FIG. 2 shows an exemplary embodiment of a lighting arrangement with a driver assembly, FIG. 3 shows a first exemplary signal-time diagram of signals in connection with the driver assembly, FIG. 4 shows a second exemplary signal-time diagram of signals in connection with the driver assembly, FIG. 5 shows a third exemplary signal-time diagram of signals in connection with the driver assembly, and FIG. 6 shows a fourth exemplary signal-time diagram of signals in connection with the driver assembly.

FIG. 1 shows an embodiment of a driver unit 100 for a not-shown lighting unit. The driver unit 100 comprises among other things a control unit 110 that comprises a test block 111, multiplexers 113, 114, a digital-analog converter IDAC 116 with current output, a control block NxGC 118, a processing block 120 for a digital feedback loop DFL and a comparator block 122 with comparators 123, 124, 125, 126. The driver assembly 100 further comprises a control register REG 128 that is coupled to the control block 118 via the multiplexer 114. An output of the digital-analog converter 116 is coupled to a voltage control output 130. The control block 118 is connected to corresponding current control outputs 140, 142 via n separate lines and also comprises n separate lines leading to measuring inputs 150, 152. The n measuring inputs 150, 152 are further connected to inverting inputs of the n separate comparators 123, 124, 125, 126 that are only partially illustrated in order to provide a better overview. The comparators 123, 124, 125, 126 are connected to a terminal for supplying a status reference value VTH with their respective non-inverting input. The outputs of the comparators lead to the test block 111 via an n-fold line.

The output side of the control block 118 is connected to the processing block 120 via a feedback line, wherein said processing block delivers a control signal FBEN to the test block 111 and one input of the multiplexer 113, particularly in digital form. A second input of the multiplexer 113 is supplied with a control value IC by the test block 111, wherein either the control value FBIN or the control value IC is delivered to the digital-analog converter 116 as a digital signal to be converted into an analog current signal at the voltage control output 130 in dependence on a first selection signal BIST1.

One input of the second multiplexer 114 is connected to the control register 128 while the second input is supplied with a control signal FBEN by the test block 111. The control of the multiplexer 114 is realized with a second selection signal BIST2 that is also made available by the test block 111. The signal delivered by the second multiplexer 114 is an n-fold signal that respectively corresponds to the number of current control outputs 140, 142 or measuring inputs 151, 152.

During regular operation, the driver assembly 100 delivers a control signal to a voltage converter via the digital-analog converter 116 in order to adjust the output voltage of said voltage converter. The output voltage is used for supplying a lighting unit with several strands of light-emitting diodes. Control values for the digital-analog converter during normal operation are made available by the processing block 120 with the signal FBIN. The strands respectively comprise a controlled current source, the control of which is realized by means of signals that are made available by the control block 118 at the current control outputs 141, 142. The adjustment of these control signals for the current sources is realized based on measuring signals that are acquired at the measuring inputs 150, 152. The output signal of the control register 128 that is fed to the control block 118 via the second multiplexer 114 makes it possible to specify during normal operation which of the n different current sources should be respectively activated or controlled and which should remain inactive.

In the test mode, the multiplexers 113, 114 can be switched over by means of the test block 111 such that the respective control signals IC and FBEN delivered by the test block 111 are respectively delivered to the digital-analog converter 116 and the control block 118. In order to respectively analyze or detect a potential error condition of the individual strands, measured values in the test mode are recorded at the measuring inputs 150, 152, processed by means of the comparator block 122 and delivered to the test block 111 for further analysis.

Possible test methods are described in greater detail below with reference to the block diagram illustrated in FIG. 2 and the signal-time diagrams illustrated in FIG. 3 to FIG. 6.

FIG. 2 shows a lighting arrangement with a driver assembly 100 according to FIG. 1. The lighting arrangement further comprises a switched voltage converter SMPS 210, a control unit SMPS CTRL 220 for the voltage converter and a lighting unit LU 230. The voltage converter 210 comprises a supply voltage input 211, to which an input voltage can be fed. A coil 212 is connected to the voltage input 211, wherein the second terminal of said coil is connected to a reference potential terminal via a switch 213 and a resistor 214 and to a voltage output 216 of the voltage converter 210 via a diode 215. A series circuit of two resistors 217, 218, as well as a capacitor 219 that is connected in parallel with this series circuit, is connected to the diode 215 on the cathode side.

The control unit 220 comprises a pulse-width modulator PWM 222, as well as a feedback block FB 224. One terminal of the feedback block 224 is connected to a connection node between the switch 213 and the resistor 214 while the second terminal of the feedback element 224 is connected to a connection node between the resistors 217, 218. On its input side, the pulse-width modulator 222 is supplied with a clock signal CLK, as well as an output signal of the feedback block 224. The output side of the pulse-width modulator 222 controls the opening state of the switch 213. A voltage conversion of the input voltage at the voltage input 211 into an output voltage at the voltage output 216 is conventionally carried out with the clocked voltage converter 210 and the corresponding control unit 220 in a so-called boost mode.

The connection node of the resistors 217, 218 is connected to the voltage control output 130 of the driver assembly 100, wherein an intensity of the output voltage at the voltage output 216 can be controlled by the intensity of the current drawn by the digital-analog converter 116.

This output voltage is delivered to a supply voltage input 231 of the lighting unit 230 and serves for the voltage supply of the several strands, particularly the n strands 240, 250, 260 of the lighting unit 230. Each of the strands 240, 250, 260 comprises a series circuit of light-emitting diodes 242, 252, 262 that are realized, in particular, in the form of LEDs. The series circuits 242, 252, 262 are respectively connected to a reference potential terminal via a current source 243, 253, 263 that is realized in the form of a MOS transistor, as well as a series-connected resistor 245, 255, 265. The control inputs of the transistors 243, 253, 263 are connected to the n current control outputs 140, 142 of the driver assembly 100. The respective second terminals 246, 256, 266 of the current sources or the transistors 243, 253, 263 are connected to the n measuring inputs 151, 152 of the driver assembly 100. The second terminals 246, 256, 266 simultaneously form a junction between the transistors 243, 253, 263 and the resistors 245, 255, 265. The second terminals 246, 256, 266 serve, for example, as current measurement terminals.

When the voltage of the voltage converter 210 is adjusted during regular operation, for example, the current sources or transistors 243, 253, 263 are controlled by the control block 118 in such a way that the respective measured values at the terminals 246, 256, 266, particularly the voltage across the resistors 245, 255, 265, reach a predetermined value. For example, at an insufficient voltage drop through one of the resistors 245, 255, 265, the gate voltage on the corresponding transistor is increased until the desired voltage is adjusted. If a further voltage increase can no longer be realized by increasing the gate voltage, a request for increasing the output voltage of the voltage converter, particularly by increasing the current drawn by the digital-analog converter 116, is delivered by means of a feedback to the processing block 120. The control therefore takes place, for example, in two stages.

However, the illustrated arrangement, particularly the driver assembly 100, also makes it possible to detect whether an error condition exists in one of the strands 240, 250, 260, particularly if one or more diodes are bypassed in a low-ohmic fashion and/or short-circuited in one of the series circuits 242, 252, 262. For this purpose, a respective control value adjusted at the input of the digital-analog converter 116 can be evaluated together with the measured value resulting from this control value at the terminals 246, 256, 266 in different variations and embodiments in order to detect irregularities that indicate an error condition in one of the strands 240, 250, 260.

FIG. 3 shows a first exemplary signal-time diagram, in which the respective signals of the driver assembly 100 or the control unit 110 are illustrated. The process of incrementally increasing the control value IC as the input value for the digital-analog converter 116 from the value 0, for example in increments of 1, begins at the time t0 such that the output voltage U of the voltage converter 210 continuously increases. At the initially low output voltage U of the voltage converter 210, no conduction takes place due to the required conducting-state voltage of the diodes such that the measured values at the second terminals 246, 256, 266 of the current sources 243, 253, 263 are virtually 0 and therefore lower than the status reference value VTH. The comparator block 122 therefore makes it possible to acquire the line statuses C1, C2, C3, Cn of the n strands 240, 250, 260 and to determine these line statuses as being non-conducting at time t0.

At the time t1, the output voltage U of the voltage converter 210 has increased to such a degree due to the continuous increase of the control value IC that the line status C1 in one of the strands changes from non-conducting to conducting. The corresponding control value IC adjusted for this change can be stored as a change-over control value for the concerned strand. The line statuses C2, C3, Cn change in a similar fashion at the times t3, t4, t5 such that corresponding change-over control values with the respectively adjusted control values IC are once again obtained.

Once all line statuses have changed from non-conducting to conducting, the maximum change-over control value of the previously acquired and stored control values that respectively lie at 9F and A0 in the present example can be determined. Subsequently, the deviations of the change-over control values of the individual strands from the maximum change-over control value can be calculated such that, for example, a difference Δ1 results for the strand with the line status C1 and a difference 42 results for the strand with the line status C2. Due to different manufacturing tolerances of the LEDs, particularly with respect to the conducting-state voltage, slight deviations of the overall minimum conducting-state voltage may occur. However, these deviations can be distinguished from more significant deviations that result from short-circuiting or bypassing diodes in one of the strands. Accordingly, a change-over threshold value TH1 can be specified as the maximum permissible deviation from the highest change-over control value in order to detect no error condition in the strand. Consequently, the strand with the line status C1 has a short circuit because the deviation 41 exceeds the change-over threshold value TH1.

FIG. 4 shows another signal-time diagram that is based on a modification of the method described with reference to FIG. 3. The sequence illustrated in FIG. 4 begins, in particular, with higher control values IC that respectively result in a higher output voltage of the voltage converter 210. For example, a control value, at which the resulting output voltage u of the voltage converter 210 is so high that all strands usually have a conducting line status, is chosen as a starting value for the control value IC. Subsequently, the control value is incrementally decreased until the last of the strands has changed its line status from conducting to non-conducting. The detection of the line status is once again realized by means of comparison of the status reference value VTH that is carried out by the comparator block 122.

Accordingly, the strands with the line statuses C2, C3, Cn change their line status from conducting to non-conducting at the times t0, t1, t2 while the strand with the line status C1 does not change to a non-conducting line status until the time t4. Similar to the method described with reference to FIG. 3, the control values at the change-over times are stored as change-over control values for the respective strand in order to subsequently determine the maximum change-over control value of the stored change-over control values. The deviation of the individual change-over control values from the maximum control value once again indicates whether an error condition exists in one of the strands.

Similar to FIG. 3, a change-over threshold value TH2 is defined in the example shown, wherein no error condition is detected for the respective strands such as, for example, the strand with the line status Cn and the deviation 42 within this change-over threshold value. The strand with the line status C1 has the deviation 41 that exceeds the change-over threshold value TH2 such that an error condition, particularly a short circuit across one or more of the diodes, is detected for this strand.

When carrying out a test for defective or, in particular, short-circuited strands of a lighting unit in accordance with the sequence described with reference to FIG. 4, the strands are initially supplied with a higher voltage U that lies, for example, in the range of the voltage during regular operation of the lighting unit. Consequently, a viewer of the lighting unit only perceives shorter dimming thereof, wherein said dimming may remain almost unnoticeable in dependence on the time of a potential error detection.

FIG. 5 shows another signal-time diagram that is based on another exemplary embodiment of a method for detecting an error condition with the driver assembly 100 or the control unit 110. In this embodiment, the test block 111 initially adjusts a first control value, in this case the value C5 that corresponds, for example, to a conventional operating point voltage for the lighting unit 230. The different line statuses C1, C2, C3, Cn of the strands 240, 250, 260 are initially determined for this adjusted control value. In the signal curve shown, a conducting status is determined for all line statuses C1, C2, C3, Cn.

Subsequently, the test block 111 adjusts the control value IC to a second control value, in this case the value B1 that corresponds to a lower voltage U. The second control value is chosen, for example, in such a way that the resulting output voltage of the voltage converter 210 leads to a non-conducting status in error-free strands.

After a settling time Ts, the corresponding line status C1, C2, C3, Cn is once again determined for each of the strands 240, 250, 260. In the corresponding signal curve, a change to the non-conducting status results for the line statuses C2, C3, Cn such that the corresponding strands can be assumed to be error-free, i.e., no error condition is detected. However, the line status C1 also remains in the conducting state after the settling time TS such that the line status of the corresponding strand for the first control value is identical to the line status of this strand for the second control value. Since no change of the line status occurs, an error condition of the corresponding strand is detected, particularly a short circuit across one or more diodes of the strand.

Due to the greater voltage jump in the method described with reference to FIG. 5, potentially visible dimming of the lighting unit 230 briefly occurs. However, the detection can be realized faster because the test is carried out in one step.

The settling time is results, for example, from the time required by the voltage converter 210 for adjusting the voltage adjusted by means of the second control value.

FIG. 6 shows another signal-time diagram that is based on an embodiment of a method for detecting an error condition with the driver assembly 100 or the control unit 110. In this case, the current sources 243, 253, 263 of eight different strands are successively activated during a test phase TT while the respective remaining strands are deactivated. The activation is realized, for example, by means of the control signal FBEN of the test block 111 that is fed to the control block 118 via the multiplexer 114. For example, no voltage is fed to the corresponding gate terminals or control terminals of the transistors in order to respectively deactivate the remaining strands or current sources. A conventional voltage control as in the operating mode is carried out for the respective single activated strand, i.e. the strand with the activated current source.

Accordingly, the control block 118 carries out a voltage control at the concerned measuring input by evaluating the measured values until the measured value reaches a predetermined value. For this purpose, the gate voltage or control voltage at the current control output of the concerned strand is adjusted, but the control value FBIN is also adapted by means of the feedback via the processing block 120 in such a way that the voltage U at the voltage converter 210 is correspondingly adjusted by means of the digital-analog converter 116.

In the respective steady state, the control value resulting for each of the strands consequently represents an appropriate voltage U for this strand. At the end of the test phase, the control values stored for the individual strands are compared with one another in order to thusly detect a possible error condition in one of the strands. An extreme value, particularly a maximum value, of the stored control values is determined, wherein the deviation of the stored control values from this extreme value is also determined for each of the strands. In an error-free strand, the deviations once again result, for example, from differences in the conducting-state voltage of the diodes that are caused by production technology. However, more significant deviations indicate that one or more diodes are short-circuited or bypassed in a low-ohmic fashion. In the exemplary signal diagram shown, a deviation Δ6 that exceeds an activation threshold value TH3 results for the sixth strand such that an error condition is detected for this sixth strand. The deviations of the remaining strands lie below the activation threshold value TH3 such that these strands are assumed to be error-free.

The test methods described with reference to FIG. 3 to FIG. 6 can be alternatively carried out with the driver assembly illustrated in FIG. 1. For example, the choice of one of the methods may depend on whether a pure test mode is implemented outside regular operation of the lighting unit or a test is carried out within brief test phases during regular operation. The embodiments of the described driver assembly 100 are characterized by a low additional circuit complexity because particularly the control of the voltage converter and the control of the current sources of the individual strands are required anyway for regular operation of the driver assembly.

In the presently described arrangement, an evaluation of a voltage at the terminals 246, 256, 266, i.e. the source terminals of the current sources 243, 253, 263 realized in the form of MOS transistors, is carried out in order to detect an error condition. Accordingly, it is possible to forgo a voltage evaluation at the drain terminals of the transistors 243, 253, 263, to which an excessively high voltage for a direct evaluation, i.e., without the utilization of additional circuit components, is usually applied. It is likewise possible to forgo external diodes that detect a maximum voltage occurring in the lighting unit 230 by means of comparators. The described embodiments of the driver assembly also do not depend on whether current sources as MOS transistors as presently described or bipolar transistors or other known current source circuits are utilized as current sources.

The voltage converter illustrated in FIG. 2 and the corresponding control unit 220 merely serve as examples of a voltage source that is controlled by the driver assembly and that serves for supplying the lighting unit 230. An alternative design of such a voltage source or voltage converter can be readily utilized in connection with the described driver assembly as long as the voltage intensity can be controlled by means of the driver assembly. Furthermore, another element that converts the control value adjusted in the driver assembly into a control signal for the current converter can also be utilized instead of the digital-analog converter with current output. It is likewise possible to directly adjust a current converter with respect to its output voltage by means of the control value.

The invention claimed is:

1. A driver assembly for a lighting unit, with the lighting unit comprising a plurality of strands with each strand featuring a series circuit of light-emitting diodes and a current source with a first and a second terminal, wherein the series circuit of diodes is connected between a supply voltage input of the lighting unit and the first terminal of the current source and the second terminal of the current source is connected to a reference potential terminal via a resistor, with the driver assembly featuring a control unit that is designed:

for generating a control signal for a voltage converter from a voltage setting value that is respectively set in the control unit, wherein the voltage converter is designed for providing an output voltage at the supply voltage input of the lighting unit based on the control signal;

for variably setting the voltage setting value;

for acquiring a measured value at each of the second terminals of the current sources while maintaining the voltage setting value, which has been set, wherein the measured values correspond to feedback received via measuring inputs;

for storing, based on the acquired measured values and for each strand, one of the voltage setting values, which have been set, wherein the stored voltage setting value corresponds to an adjusted value at the input of a digital-analog converter;

for determining a line status of each individual strand for the voltage setting value, which has been set, based on the acquired measured values; and for detecting an error condition in one of the strands based on the stored voltage setting values and based on the determined line statuses for at least two different voltage setting values, such that at least one adjusted value at the input of the digital-analog converter is evaluated together with the acquired measured values in order to detect the error condition.

2. The driver assembly according to claim 1, wherein the control unit is designed for detecting whether one or more diodes are electrically bypassed, particularly bypassed in a low-ohmic fashion, and/or short-circuited in one of the strands based on the stored voltage setting values.

3. The driver assembly according to claim 1, wherein the control unit is designed for determining the line status of the strand by means of a comparison of the measured value acquired at the second terminal of the current source of the strand with a status reference value.

4. The driver assembly according to claim 1, wherein the control unit is designed:

for incrementally setting the voltage setting value in several steps;

for determining the voltage setting value for each strand, at which the line status of the strand changes, based on the line statuses determined for the voltage setting values, which have been set, in order to obtain a change-over voltage setting value for the strand; and for detecting whether an error condition exists in one of the strands based on the change-over voltage setting values.

5. The driver assembly according to claim 4, wherein the control unit is designed for determining an extreme value of the change-over voltage setting values and for detecting an error condition in a strand if a deviation between the change-over voltage setting value of this strand and the extreme value exceeds a change-over threshold value.

6. The driver assembly according to claim 1, wherein the control unit is designed:

for setting the voltage setting value to a first voltage setting value and for determining the line status of each individual strand for the first voltage setting value;

for setting the voltage setting value to a second voltage setting value and for determining the line status of each individual strand for the second voltage setting value; and for detecting an error condition in a strand if the line status of this strand for the first voltage setting value is identical to the line status of this strand for the second voltage setting value.

7. The driver assembly according to claim 6, wherein the first voltage setting value is provided for a higher output voltage of the voltage converter than the second voltage setting value.

8. The driver assembly according to claim 1, wherein the line status is defined by a conducting status or a non-conducting status of the strand.

9. A driver assembly for a lighting unit, with the lighting unit comprising a plurality of strands with each strand featuring a series circuit of light-emitting diodes and a current source with a first and a second terminal, wherein the series circuit of diodes is connected between a supply voltage input of the lighting unit and the first terminal of the current source and the second terminal of the current source is connected to a reference potential terminal via a resistor, with the driver assembly featuring a control unit that is designed:

for generating a control signal for a voltage converter from a voltage setting value that is respectively set in the control unit, wherein the voltage converter is designed for providing an output voltage at the supply voltage input of the lighting unit based on the control signal;

for variably setting the voltage setting value;

for activating the current source of each strand individually and deactivating the current sources of the other strands;

for acquiring a measured value at each of the second terminals of the activated current sources while maintaining the voltage setting value, which has been set, wherein the measured values correspond to feedback received via measuring inputs;

for setting the voltage setting value in such a way that the measured value on the strand with the activated current source reaches a predetermined value;

for storing, based on the acquired measured value, the voltage setting value that has been set in the way for the strand with the activated current source, wherein the stored voltage setting value corresponds to an adjusted value at the input of a digital-analog converter; and for detecting an error condition in one of the strands based on a comparison of the stored voltage setting values, such that at least one adjusted value at the input of the digital-analog converter is evaluated together with the acquired measured values in order to detect the error condition.

10. The driver assembly according to claim 9, wherein the control unit is designed for determining an extreme value of the stored voltage setting values and for detecting an error condition in a strand if a deviation between the stored voltage setting value of this strand and the extreme value exceeds an activation threshold value.

11. A lighting arrangement with a driver assembly according to one of claims 1-2 and 4-10, with a lighting unit, with the lighting unit comprising a plurality of strands, each of which comprises a series circuit of light-emitting diodes and a current source with a first and a second terminal, wherein the series circuit of diodes is connected between a supply voltage input of the lighting unit and the first terminal of the current source and the second terminal of the current source is connected to a reference potential terminal via a resistor, and with a voltage converter that is designed for making available an output voltage at the supply voltage input of the lighting unit based on a control signal delivered by the driver assembly.

12. The driver assembly according to claim 9, wherein the respective measured values are acquired without involving a voltage at any of the first terminals of the current sources.

13. A method for detecting an error condition of a lighting unit, with the lighting unit comprising a plurality of strands, each of which comprises a series circuit of light-emitting diodes and a current source with a first and a second terminal, wherein the series circuit of diodes is connected between a supply voltage input of the lighting unit and the first terminal of the current source and the second terminal of the current source is connected to a reference potential terminal via a resistor, the method comprising the steps of:

successively setting at least two voltage setting values in a variable fashion;

generating a control signal for a voltage converter from each of the voltage setting values, which have been set, wherein the voltage converter is designed for making available an output voltage at the supply voltage input of the lighting unit based on the control signal;

acquiring a measured value at each of the second terminals of the current sources, wherein the measured values correspond to feedback received via measuring inputs;

storing, based on the acquired measured values and for each strand, one of the voltage setting values, which has been set, wherein the stored voltage setting value corresponds to an adjusted value at the input of a digital-analog converter;

determining a line status of each individual strand for the voltage setting value, which has been set, based on the acquired measured values; and detecting an error condition in one of the strands based on the stored voltage setting values and based on determined line statuses for at least two different voltage setting values, such that at least one adjusted value at the input of the digital-analog converter is evaluated together with the acquired measured values in order to detect the error condition.

14. The method according to claim 13, further comprising the steps of:

incrementally setting the voltage setting value in several steps;

determining the voltage setting value for each strand, at which the line status of the strand changes, based on the line statuses determined for the voltage setting values, which have been set, in order to obtain a change-over voltage setting value for the strand; and detecting whether an error condition exists in one of the strands based on the change-over voltage setting values.

15. A method for detecting an error condition of a lighting unit, with the lighting unit comprising a plurality of strands, each of which comprises a series circuit of light-emitting diodes and a current source with a first and a second terminal, wherein the series circuit of diodes is connected between a supply voltage input of the lighting unit and the first terminal of the current source and the second terminal of the current source is connected to a reference potential terminal via a resistor, the method comprising the steps of:

successively setting at least two voltage setting values;

generating a control signal for a voltage converter from each of the voltage setting values, which have been set, wherein the voltage converter is designed for making available an output voltage at the supply voltage input of the lighting unit based on the control signal;

for variably setting the voltage setting value;

activating the current source of each strand individually and deactivating the current sources of the other strands;

acquiring a measured value at each of the second terminals of the current sources while maintaining the voltage setting value, which has been set, wherein the measured values correspond to feedback received via measuring inputs;

setting the voltage setting value in such a way that the measured value of the strand with the activated current source reaches a predetermined value;

storing, based on the acquired measured value, the voltage setting value which has been set in the way for the strand with the activated current source, wherein the stored voltage setting value corresponds to an adjusted value at the input of a digital-analog converter; and detecting an error condition in one of the strands based on a comparison of the stored voltage setting values, such that at least one adjusted value at the input of the digital-analog converter is evaluated together with the acquired measured values in order to detect the error condition.

16. The method according to claim 13 or 15, wherein the respective measured values are acquired without involving a voltage at any of the first terminals of the current sources.

* * * * *